US006745853B2

(12) United States Patent
Turner et al.

(10) Patent No.: US 6,745,853 B2
(45) Date of Patent: Jun. 8, 2004

(54) METHODS AND APPARATUS FOR OPEN HOLE DRILLING

(75) Inventors: Katherine M. Turner, Houston, TX (US); Carey John Naquin, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 10/265,028

(22) Filed: Oct. 4, 2002

(65) Prior Publication Data

US 2004/0065474 A1 Apr. 8, 2004

(51) Int. Cl.[7] ..... E21B 7/12
(52) U.S. Cl. ..... 175/5; 175/7; 175/73
(58) Field of Search ..... 175/5, 7, 8, 9, 175/10, 73, 74

(56) References Cited

U.S. PATENT DOCUMENTS 6,085,838 A 7/2000 Vercaemer et al. ..... 166/277
6,296,066 B1 10/2001 Terry et al. ..... 175/92
6,415,877 B1 * 7/2002 Fincher et al. ..... 175/5
6,554,075 B2 * 4/2003 Fikes et al. ..... 166/379
6,648,081 B2 * 11/2003 Fincher et al. ..... 175/25

* cited by examiner

*Primary Examiner*—Frank Tsay
(74) *Attorney, Agent, or Firm*—Conley Rose, P.C.

(57) ABSTRACT

Methods and apparatus are disclosed for the open hole drilling of a borehole from an offshore platform and through a cased borehole at the seafloor. The drilling assembly includes a guide assembly extending from the platform to the seafloor and having a lower end extending into the cased borehole; and a bottomhole assembly disposed on a lightweight drill string extending through the guide assembly for drilling the borehole. The guide assembly is a pipe string and preferably includes a casing and a riser attached to the casing. The lightweight drill string may be a jointed pipe, a metal coiled tubing, or preferably a composite coiled tubing. The bottomhole assembly includes a formation displacement member adapted to drill a borehole having a diameter greater than the diameter of the guide assembly. The drilling assembly uses a drilling fluid that flows through the drill string and the bottomhole assembly, through a fluid passageway around the bottomhole assembly, and between said lower end and the cased borehole into the sea.

30 Claims, 9 Drawing Sheets

METHODS AND APPARATUS FOR OPEN HOLE DRILLING

CROSS-REFERENCE TO RELATED APPLICATIONS

The present application is related to application Ser. No. 10/264,549, filed Oct. 4, 2002 and entitled Methods and Apparatus for Riserless Drilling, hereby incorporated herein by reference in its entirety.

STATEMENT REGARDING FEDERALLY SPONSORED RESEARCH OR DEVELOPMENT

Not Applicable.

BACKGROUND OF THE INVENTION

1. Field of the Invention

The present invention relates generally to methods and apparatus for drilling an offshore well from a platform, and more particularly, to methods and apparatus for the open hole drilling of a subsea borehole using lightweight pipe components, and still more particularly, to methods and apparatus for drilling a conductor casing borehole through a riser with a lightweight drill string.

2. Description of the Related Art

Offshore hydrocarbon drilling and producing operations are typically conducted from a drilling rig located either on a bottom-founded offshore platform or on a floating platform. A bottom-founded platform extends from the seafloor upwardly to a deck located above the surface of the water, and at least a portion of the weight of the platform is supported by the seafloor. In contrast, a floating platform is a ship, vessel, or other structure, such as a tension-leg platform, for example, in which the weight of the platform is supported by water buoyancy.

In recent years, exploration and production of offshore crude oil and natural gas reservoirs has expanded into ever-deeper waters. Successful drilling operations have been conducted in deep waters of at least 3,000 feet deep, and ultra-deep waters ranging from 5,500 to 10,000 feet deep. With increasing water depths, drilling operations conducted from moored or dynamically positioned floating platforms have become more prevalent since economic and engineering considerations militate against the use of bottom-founded drilling platforms commonly used in shallow water.

Regardless of whether a bottom-founded or floating platform is used, conventional methods for drilling an offshore well are similar. In such operations, the platform supports a drilling rig and associated equipment, and must include adequate deck space for pipe storage and handling. The platform is positioned near the wellsite, and a drill string, typically formed of jointed steel pipe that is threaded together one joint at a time, conveys a bottom-hole drilling assembly (BHA) from the platform to the seafloor. A drill bit, disposed at the terminal end of the BHA, drills the well.

Riserless Drilling

When drilling from a floating platform, the upper portion of the well is drilled by open hole drilling in that no conduit is provided for the returns to flow to the platform. Therefore, in open hole drilling the returns, i.e. the drilling fluid, cuttings, and well fluids, are discharged onto the seafloor and are not conveyed to the surface. To drill the initial upper portion of the well, the drill string typically extends unsupported through the water to the seafloor without a riser. In more detail, first an outer casing, known as "structural casing", typically having a diameter of 30-inches to 36-inches, is installed in the uppermost section of the well, with a low-pressure wellhead housing connected thereto. In soft formations, the structural casing is typically jetted into place. In this process, an assembly is lowered to the seafloor on a conventional drill string. The assembly includes the structural casing, and typically, a BHA with drill collars, a downhole motor, and a drill bit. The bit is positioned just below the bottom end of the structural casing and is sized to drill a borehole with a slightly smaller diameter than the diameter of the casing. As the borehole is drilled, the structural casing moves downwardly with the BHA. The weight of the structural casing and BHA drives the casing into the sediments. The structural casing, in its final position, generally extends downwardly to a depth of 150 to 400 feet, depending upon the formation conditions and the final well design. After the structural casing is in place, it is released from the drill string and BHA. The drill string and BHA are then tripped back to the platform, or are, in some cases, lowered to drill below the structural casing.

In more competent formations, the structural casing is similar, but it is installed in a two-step process. First, a borehole larger than the structural casing is drilled. Then the structural casing is run into the borehole and cemented into place. Typically, the low-pressure wellhead housing is connected to the upper end of the structural casing and installed at the same time, such that the structural casing extends below the seafloor with the low-pressure wellhead housing above the seafloor.

Once the structural casing and the low-pressure wellhead housing are installed, the BHA on the drill string drills downwardly below the structural casing to drill a new borehole section using open hole drilling for an intermediate casing, known as "conductor casing," which is typically 20-inches in diameter. Thus, the structural casing guides the BHA as it begins to drill the conductor casing interval. During open hole drilling, returns of the drilling fluid and cuttings are discharged onto the seafloor.

After the borehole section for the conductor casing is drilled, the BHA is tripped to the surface. Then conductor casing, with a high-pressure wellhead housing connected to its upper end, and a float valve disposed in its lower end, is run into the drilled conductor borehole section extending below the structural casing. The conductor casing is cemented into place in a well known manner, with the float valve preventing cement from flowing upwardly into the conductor casing after cement placement. The conductor casing generally extends downwardly to a depth of 1,000 to 3,000 feet below the seafloor, depending on the formation conditions and the final well design. The high-pressure wellhead housing engages the low-pressure wellhead housing to form the subsea wellhead, thereby completing the riserless portion of the drilling operations. A subsea blowout preventer (BOP) stack is typically conveyed down to the seafloor by a riser and latched onto the subsea wellhead housing. The riser is thereby installed with its lower end connected to the subsea wellhead via the BOP stack and the riser extending to the platform at the surface. Subsequent casing strings are hung and well operations are conducted through the subsea wellhead.

Riserless drilling, as described above for drilling the conductor casing borehole, is conventionally performed using a drill string formed of steel pipe joints having a size and weight sufficient to withstand the lateral forces imposed by water currents. However, this conventional method of riserless drilling has a number of disadvantages, especially when drilling from a floating platform in deep or ultra-deep waters.

Drilling with a Riser

Once the well reaches a certain depth, further drilling requires the use of a weighted drilling fluid to maintain control of downhole pressures, and such drilling fluids are costly enough to warrant returning the drilling fluid to the platform for cleaning so that the same drilling fluid may be recirculated for further drilling. Thus, after the riserless drilling portion of the well has been drilled and cased, a low-pressure riser, formed by joining sections of casing or pipe that is typically 21-inches in diameter, is deployed between the floating platform and the wellhead equipment. The riser is provided to guide the drill string to the wellhead equipment for conducting further well drilling operations, and to provide a conduit for returning drilling fluid from the well to the floating platform.

Once the riser is in place, the drill string and BHA are lowered through the riser, the subsea wellhead, and the conductor casing to drill through the float valve into the seafloor to form another borehole section for another string of casing. The next casing, known as "surface casing," which is typically 13⅜ to 16 inches in diameter, is lowered into the drilled borehole and cemented into place via conventional procedures. The surface casing generally extends to a depth of 2,500 to 5,000 feet below the seafloor, depending on the formation characteristics and final well design. Subsequent, smaller diameter, intermediate casing strings may be installed below the surface casing.

This conventional method of drilling with a riser from a platform has a number of disadvantages, especially when drilling from a floating platform in deep or ultra-deep waters. First, the required size and capacity of the platform is largely based on the depth of water, and the corresponding amount of pipe required to drill the well. The larger the pipe, and the more pipe required to form the riser, the greater the weight and space requirements of the drilling rig and floating platform. To handle the weight of a large and long drill string, and a large and long riser, the floating platform must be equipped with a conventional drilling rig and must have significant deck space for storing and handling the large amount of pipe for the drilling operation.

Thus, as water depth increases, larger floating platforms are required for larger drilling rigs to handle and support the added weight of the pipe due to the greater depth and to store the additional pipe, thereby significantly increasing the costs of drilling as water depth increases. Further, tripping into and out of the well with jointed pipe is very time-consuming since each joint of pipe must be threaded and/or unthreaded to the pipe string extending through the water and into the well. As an additional concern, the number of trips into and out of the well, and the heave and roll of the floating platform, impose fatigue stresses on the metal pipe extending down to the seafloor from the floating platform. Heave compensators on the floating platforms compensate for the heave of the floating platform and help to protect the pipe from excess fatigue.

Various improvements may be made to overcome the deficiencies of conventional drilling operations. It would be advantageous to reduce the size of the platform, particularly floating platforms required for deep water. One way to enable the use of a smaller platform would be to reduce the capacity requirement of the hoisting system, which would allow reduction of the drilling rig size, or would allow replacement of the drilling rig with a smaller capacity hoisting system. Further, the diameter and therefore the weight of the pipe, such as drill pipe, casing, and risers, could be reduced, thereby no longer requiring a large drilling rig to handle the pipe, and no longer requiring large storage space on the platform for the pipe. To achieve these objectives, it would be preferred to eliminate large risers and to use smaller risers. This will reduce the required drilling rig size and the amount of storage space required. When the riser diameter is reduced to the preferred smaller diameter, a conventionally sized drill string is too large to extend through the riser. For this reason, a smaller diameter drill string must be used when drilling through the preferred smaller diameter riser. A reduction in drill string diameter typically results in a proportional reduction in the weight of the drill string. Thus, in order to maximize efficiency, it would be preferable to use the same, smaller diameter, lighter drill string for conducting the riserless drilling operations described above. In addition to enabling the use of a smaller riser, the use of a smaller, lighter drill string is preferable because its lighter weight directly reduces the vessel size requirement.

For these reasons, it would be preferable to use a lighter weight drill string. It would be more preferable to use a non-jointed, continuous lighter weight drill string such as coiled tubing stored on a reel, thereby reducing the deck space required to store the drill string. Further, because a coiled tubing drill string is a continuous, single length of tubing that may be continuously fed from the reel into the water and down into the well, the time required to connect and disconnect the joints of a conventional drill string is eliminated, thereby significantly reducing the overall time required to conduct drilling operations. It would be still more preferable to use a non-metal coiled tubing drill string, such as the composite coiled tubing disclosed in U.S. Pat. No. 6,296,066 to Terry et al., hereby incorporated herein by reference for all purposes. Composite coiled tubing is preferable to metal pipe or metal coiled tubing because it weighs less and is substantially less subject to fatigue inducing stress variations due to trips into and out of the well and movement of the floating platform.

Drill string weight may be reduced by reducing the wall thickness of the drill string, or by altering the material that forms the drill string, such as by using a lightweight metal like titanium, or by using a lightweight composite material. A composite coiled tubing drill string may be formed of helically wounded or braided fiber reinforced thermoplastic or fiber reinforced thermosetting polymer or epoxy, for example. It should be appreciated that one or more of these concepts may be combined to reduce drill string weight, resulting in a lightweight drill string. However, as the drill string is made lighter, it becomes more susceptible to the effects of water currents. The lighter the drill string, the more severe the effects. Because water currents vary with depth and with time, and because the variability of the currents increases with increasing water depth, it is difficult to precisely predict deepwater currents and thus to design for their adverse effects. In particular, water currents have various impacts on a lightweight drill string and BHA during riserless drilling. As used herein, a lightweight drill string is defined as a drill string, which is lighter than that used in conventional drilling, and which requires alternative systems and methods to conduct riserless drilling due to factors associated with its light weight, such as its response to water currents.

Conventional riserless drilling system and methods cannot be used with a lightweight drill string due to the conventional systems' inability to counteract the effects of the water currents on the lightweight drill string. Because the drill string is laterally constrained at the platform and at the point of entry into the borehole at the seafloor the drill string will bow as the water currents impose lateral forces against it. As water depth increases, the bowing effect of the drill string increases because there is a greater length of the drill string upon which the water currents act. The bowing of the drill string exerts an upward force on the BHA, tending to pull the BHA out of the borehole. This upward force reduces weight-on-bit (WOB) and possibly lifts the bit off bottom, thereby preventing successful drilling.

Furthermore, as the weight of the drill string is reduced and the water depth increases, the tendency of the drill string to kink increases, particularly at the floating platform and at the seafloor where the drill string is laterally constrained. Thus, if the drill string bends too sharply, it will kink, and ultimately fail. Therefore, it would be advantageous to provide methods and apparatus to counteract the effects of water currents such that successful drilling of the conductor casing borehole can be achieved using a lightweight drill string.

Another disadvantage of the conventional method described above is that two different pipe trips are performed to drill a borehole for casing and to install the casing, respectively, such that the open borehole could experience catastrophic failure due to shallow water flows, making it impossible for the casing to be run into the borehole. The longer the delay between drilling the borehole and running the casing into the borehole, the more likely the borehole will collapse before the casing can be run in. In ultra deep water of 10,000 feet, for example, a single roundtrip of the drill string can take up to an entire day. Thus, it would be advantageous to minimize the delay between drilling a borehole and running casing into that borehole.

The present invention overcomes the deficiencies of the prior art.

SUMMARY OF THE INVENTION

The methods and apparatus of the preferred embodiments are for the open hole drilling of a borehole from an offshore platform and through a cased borehole at the seafloor. The drilling assembly includes a guide assembly extending from the platform to the seafloor and having a lower end extending into the cased borehole; and a bottomhole assembly disposed on a lightweight drill string extending through the guide assembly for drilling the borehole. The guide assembly is a pipe string and preferably includes a casing on the lower end and a riser attached to the upper end of the casing. The lightweight drill string may be a lightweight jointed pipe, or a metal coiled tubing, or preferably a composite coiled tubing. The bottomhole assembly includes a formation displacement member adapted to drill a borehole diameter greater than the diameter of the casing on the lower end of the guide assembly. For example, the formation displacement member may include a bi-center bit, or a conventional bit with an underreamer, or a conventional bit with a winged reamer. A drilling fluid is used that flows through the drill string and the bottomhole assembly, through a fluid passageway around the bottomhole assembly, and between the lower end and the cased borehole into the sea.

The present invention further comprises a method of open hole drilling of a new borehole through a cased borehole at the seafloor, the method comprising lowering a guide assembly from a platform through a depth of water; stabbing the guide assembly into the cased borehole; extending a bottomhole assembly suspended on a drill string through the guide assembly; drilling the new borehole; and lowering the guide assembly into the new borehole. In one embodiment, the method further comprises disposing a float valve at the lower end of the guide assembly; cementing the guide assembly into the new borehole; extending the bottomhole assembly suspended on the drill string through the guide assembly; and drilling a subsea borehole below the guide assembly.

Thus, the preferred embodiments of the present invention comprise a combination of features and advantages that overcome various problems of prior methods and apparatus. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiments of the present invention, reference will now be made to the accompanying drawings, in which like elements have been given like numerals, wherein.

DESCRIPTION OF THE PREFERRED EMBODIMENTS

Figure 1:
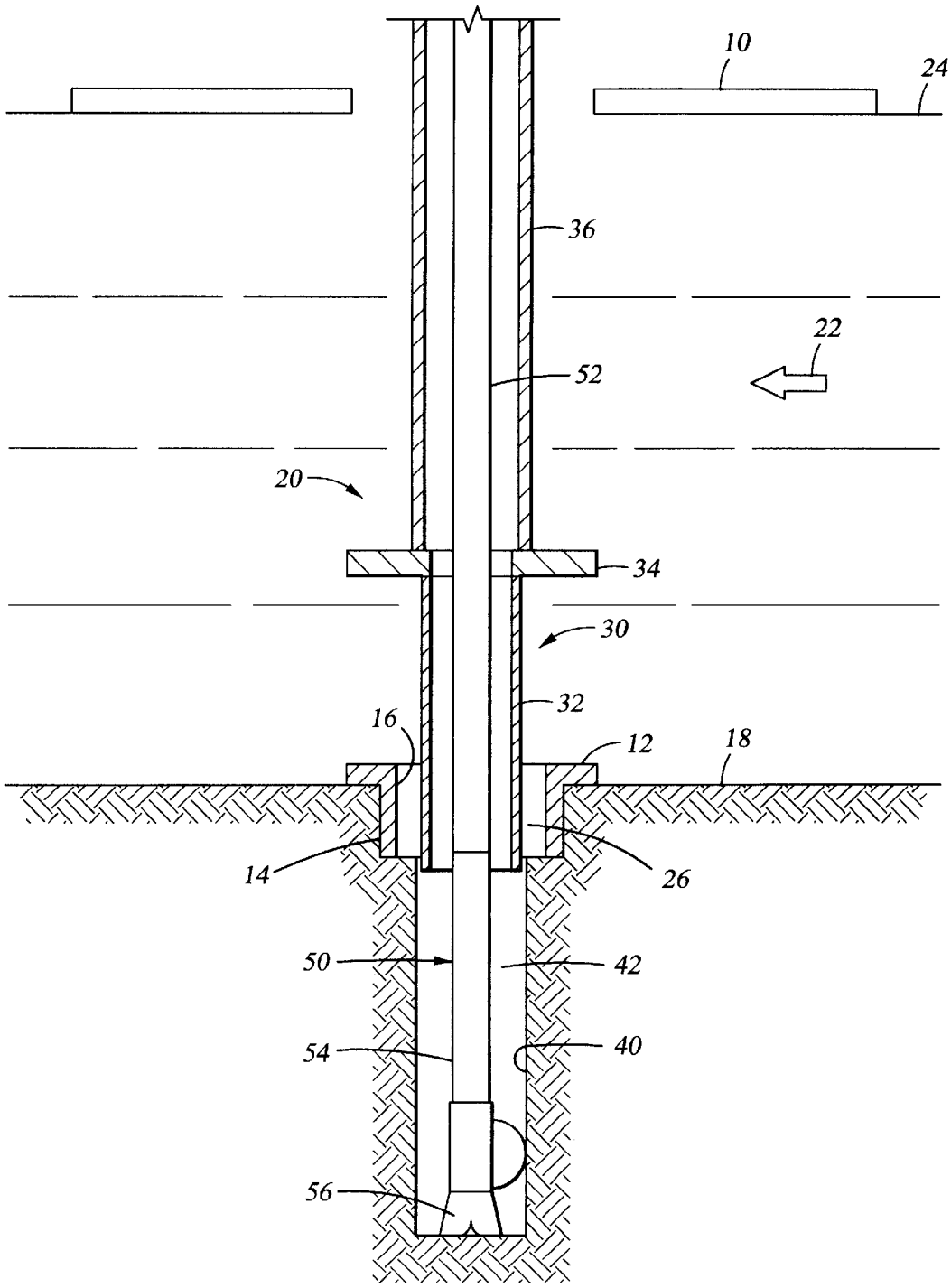
FIG. 1 is a schematic elevational view of a preferred embodiment of the drilling system and method for open hole drilling.

The present invention is susceptible to embodiments of different forms. There are shown in the drawings, and herein will be described in detail, specific embodiments of the present invention with the understanding that the present disclosure is to be considered only an exemplification of the principles of the invention, and is not intended to limit the invention to that illustrated and described.

The apparatus and methods of the present invention are used for offshore drilling from a platform using a drill string suspending a BHA. Various embodiments of the present invention provide a number of different configurations of the drill string, the BHA, the type of platform from which drilling operations occur (i.e. bottom-founded or floating), the depth of the water, and the sizes of pipe components, such as risers and casings. It should be appreciated that the embodiments of the present invention, therefore, provide a plurality of methods and apparatus for offshore drilling from a platform. Thus, it is to be fully recognized that the different teachings of the embodiments discussed herein may be employed separately or in any suitable combination to produce desired results. In particular, the present system may be used in practically any type of offshore drilling operation.

Referring initially to FIG. 1, there is shown an offshore platform 10 disposed over a subsea wellhead 12 extending into a well 14 and forming a cased borehole 16. An offshore drilling system 20 is shown that includes a guide assembly 30, such as a pipe string, extending from the platform 10 to a wellhead 12 at the seafloor 18. Guide assembly 30 extends into the cased borehole 16 a sufficient distance to anchor the lower end of guide assembly 30 against water currents 22. The lower terminal end of guide assembly 30 forms an annulus 26 with the cased borehole 16. In a preferred embodiment, guide assembly 30 includes a casing 32 disposed on a casing head 34 and a riser 36 connected to the upper end of casing head 34. Preferably, the casing 32 is installed in the new borehole 40 being drilled and the riser 36 extends from the wellhead 12 to the platform 10 at the surface 24. Casing head 34 is adapted for support and connection to the subsea wellhead 12 and may be a subsea wellhead. Riser 36 may be either a high-pressure riser or a low-pressure riser. After drilling the new borehole 40, pressure control equipment may be disposed either on the lower end, or on the upper end, or both, of a high pressure riser 36 for the drilling of subsequent boreholes. Alternatively, if the riser 36 is a low-pressure riser, pressure control equipment must be disposed on the lower end of the riser 36 since the riser 36 cannot contain wellhead pressures.

Guide assembly 30 comprises a casing 32 and riser 36 because it is preferred to use conventional sized casing and riser. Utilizing a conventional casing and riser, the outside diameter of the casing 32 is larger than the inside diameter of the riser 36, thus requiring that the casing 32 be attached to the lower end of the riser 36. However, it should be appreciated that the guide assembly 30 may merely be a pipe string, such as a specialty riser, sized to allow the casing to pass through the riser. Thus, it should be appreciated that the guide assembly 30 may be solely made up of riser pipe extending from the seafloor to the surface.

The offshore drilling system 20 further includes a drilling assembly 50. The drilling assembly 50 includes a lightweight drill string 52 and a bottomhole assembly 54 having a formation displacement member 56 on its lower end for drilling a new borehole 40. Guide assembly 30 guides drilling system 50 from the platform 10 to the seafloor 18 through currents 22. Further, guide assembly 30 supports the lightweight drill string 52 and shelters the drill string 52 from currents 22. Lightweight drill string 52 may be formed of jointed pipe but is preferably a continuous drill string that does not include joints and may be disposed on a reel on platform 10. Lightweight drill string 52 has such a light weight that drill string 52 could not be used in open water due to currents 22. Lightweight drill string 52 may be metal coiled tubing and preferably is composite coiled tubing. Formation displacement member 56 is sized to pass through guide assembly 30 and is configured to drill the borehole 40 to a diameter that is greater than the diameter of guide assembly 30 such that guide assembly 30 can be received within the new borehole 40. Formation displacement member 56 may include a bi-center bit or a conventional bit with an underreamer or a conventional bit with a winged reamer whereby borehole 40 will have a diameter adequate to receive casing 32 on guide assembly 30.

The offshore drilling system 20 utilizes a drilling fluid to pass down the flowbore of the drill string 52 and through formation displacement member 56. The returns will then pass up the annulus 42 formed between drill string 52 and the borehole 40, and up the annulus 26 formed between the guide assembly 30 and the cased borehole 16, then into the sea water adjacent the seafloor 18.

In operation, the guide assembly 30 is lowered from the platform 10 with its lower terminal end being received within cased borehole 16. Guide assembly 30 is thus anchored at its lower end by the cased borehole 16 and at its upper end by the platform 10. Drilling assembly 50 is then lowered through guide assembly 30, with the formation displacement member 56 drilling a new borehole 40 below cased borehole 16. Upon drilling assembly 50 completing the drilling of the new borehole 40, drilling assembly 50 is removed from guide assembly 30. Guide assembly 30 is then lowered into the new borehole 40 until casing head 34 lands and is connected to subsea wellhead 12. It should be appreciated that new riser joints are added to the upper end of guide assembly 30 as casing 32 is lowered into borehole 40. A float valve (not shown) is then disposed in the lower end of guide assembly 30. Casing 32 is then cemented in place within borehole 40 and riser 36 may serve as a high pressure or a low-pressure riser extending from the wellhead 12 to the platform 10. Well control equipment (not shown), such as a blowout preventer, may be installed on either the upper end, or the lower end, or both, of a high pressure riser 36, but must be installed on the lower end of a low pressure riser 36. Another subsea borehole may now be drilled below borehole 40 by again lowering drilling assembly 50 through the riser 36 and casing 32 for the drilling of one or more additional boreholes.

Figure 2:
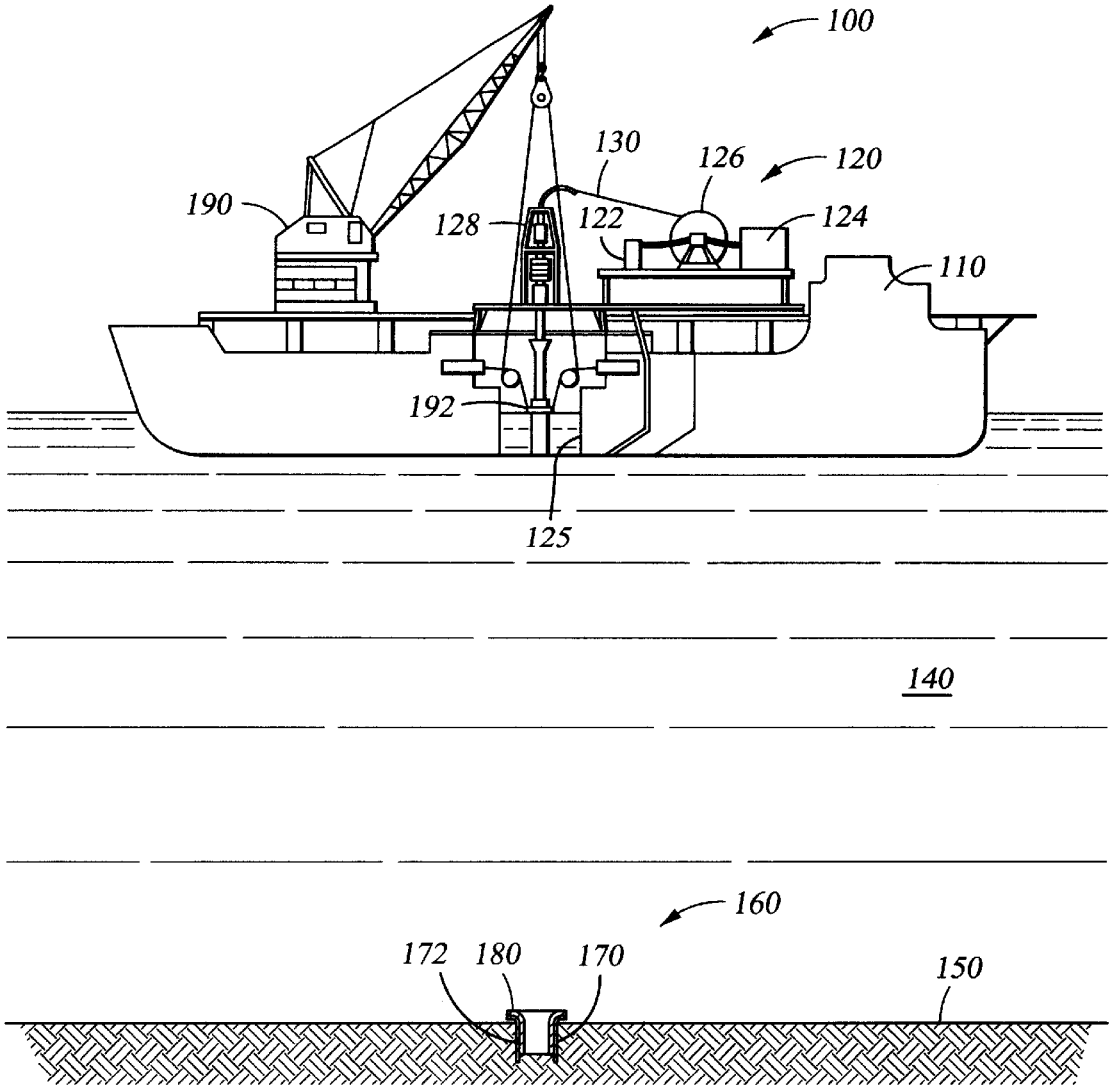
FIG. 2 is a schematic elevational view of a floating platform with a crane and a coiled tubing system situated over a structural casing and low-pressure wellhead housing installed at the subsea wellsite.

Referring now to FIGS. 2–5 and 7–9, which are illustrations of different stages in the open hole drilling of a borehole using a preferred drilling system. In FIG. 2 there is shown one exemplary operating environment for the preferred embodiments of the present invention. Although the present invention is applicable in any water depth, the deeper the water, the greater the advantages of the present invention. For purposes of describing a preferred embodiment of the present invention, FIG. 2 represents a deepwater well where the present invention is particularly advantageous. An offshore floating drilling platform 100 comprises a floating vessel 110 having a coiled tubing system 120 with a power supply 122, a surface processor 124, and a coiled tubing spool 126. An injector 128 feeds and directs the coiled tubing 130 from the spool 126 downwardly through the moonpool 125 towards the seafloor 150. In preferred embodiments, the floating platform 100 is not equipped with a conventional sized drilling rig because the weight of the required drilling equipment and pipe can be supported by a lower capacity hoisting system, such as a smaller conventional derrick (not shown) or crane 190. Heave compensator 192 may be disposed adjacent the moonpool 125.

In FIG. 2, the floating platform 100 is shown situated adjacent a subsea wellsite 160 in which structural casing 170 and a low-pressure wellhead housing 180 have previously been installed conventionally. Casing 170 forms a cased borehole 172. Due to the preferably smaller diameter drill string 135, hereinafter described, the structural casing 170 is preferably smaller in diameter than structural casing for conventional wells, and most preferably, the structural casing 170 has a diameter less than 30-inches to 36-inches, such as, for example, 7⅝-inches. Such dimensions are particularly advantageous in drilling a slimhole well.

Figure 3:
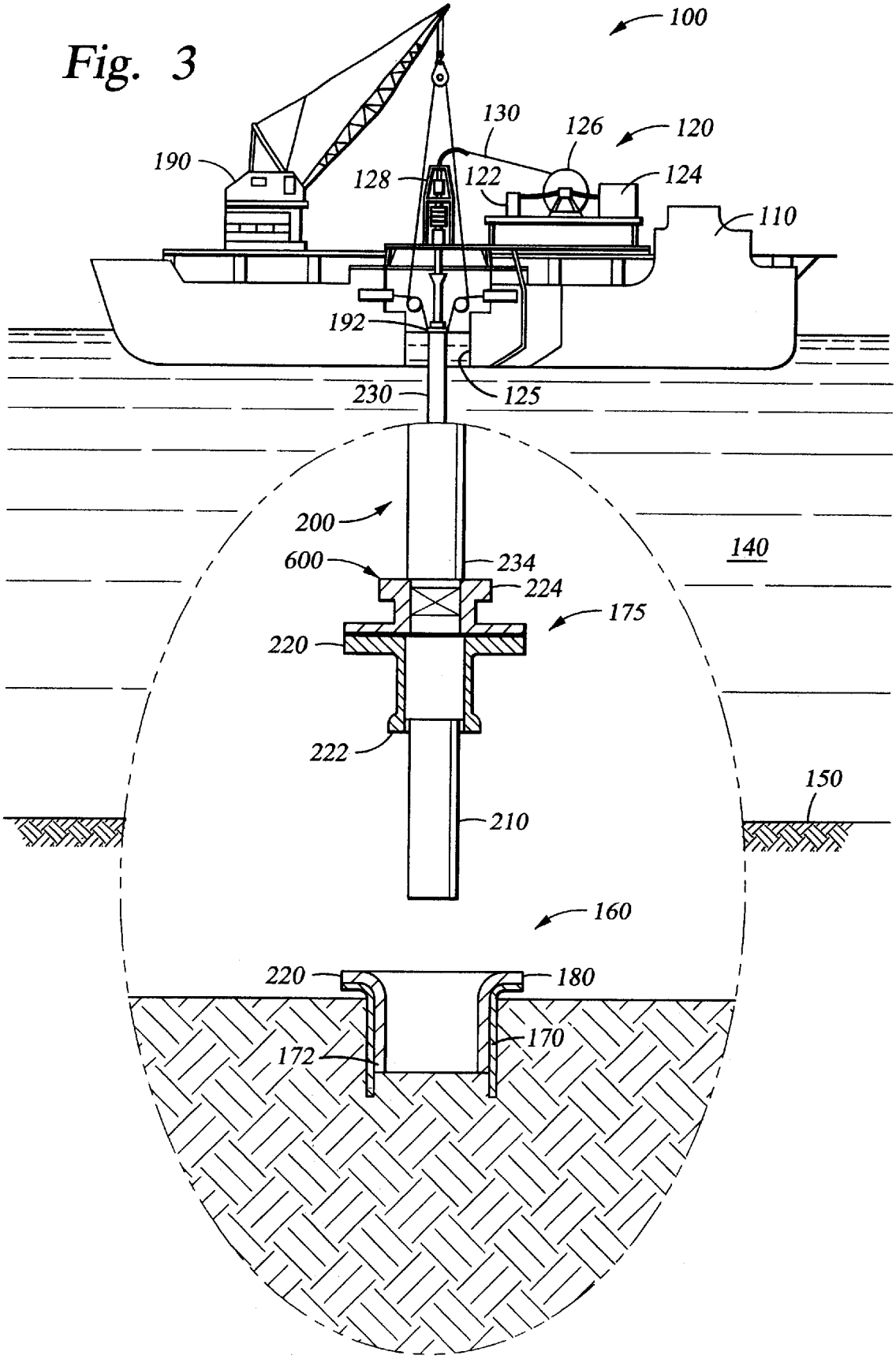
FIG. 3 is a schematic elevational view of the wellsite of FIG. 2 depicting a guide assembly being lowered from a floating platform through the water to the seafloor.

Referring now to FIG. 3, a drilling system 175 includes a guide assembly 200 that extends from the heave compensator 192 on floating platform 100, through the moonpool 125, and into the water 140. The guide assembly 200 comprises a pipe string preferably made up of a conductor casing 210, a high-pressure wellhead housing 220, and a high-pressure riser 230. Alternatively, the riser 230 may be a low pressure riser comprising small diameter pipe. The conductor casing 210 is connected to the lower end 222 of the high-pressure wellhead housing 220, and the high-pressure wellhead housing 220 is releasably connected at 224 to the lower end 234 of the riser 230. The releasable connection 224 may be an emergency disconnect and valve assembly, for example, that enables the riser 230 to be released from the wellhead housing 220 following the well drilling operation. The emergency disconnect and valve assembly 224 is also provided to enable quick release of the riser 230 from the wellhead housing 220 and automatic shutoff for drilling fluid containment should the vessel 110 float away from the wellsite 160 during inclement weather, for example. Thus, the conductor casing 210, the high-pressure wellhead housing 220, and the riser 230 are run through the water 140 as a connected guide assembly 200.

In preferred embodiments, the conductor casing 210 and the riser 230 may be conventional casing and riser which have significantly smaller diameters than comparable casing and risers used in conventional offshore drilling systems. However, the conductor casing 210 and riser 230 must both be large enough for a lightweight drill string 130 to extend therethrough.

The preferred embodiment is particularly applicable to slimhole drilling of a shallow well through deep water. A slimhole is typically defined in the industry as a borehole having a diameter of 6½ inches or less, but may include a borehole having a diameter up to even 8½ inches if the interval to be drilled is very long. The objective of slimhole drilling is to avoid drilling large boreholes for the installation of concentric casing strings, each having progressively smaller diameters.

In one preferred embodiment, the conductor casing 210 has an OD of 5½ to 5¾ inches with an inner diameter (ID) of 4¾ to 5 inches, for example, and a conventional high-pressure well completion riser 230 has an OD of 7 inches and an ID of 5 inches, for example. Since a conventional high-pressure riser has a 5-inch ID, the conductor casing with a 5½ to 5¾ inch OD cannot pass through the riser. Thus conductor casing 210 is lowered first rather than the riser 230. Guide assembly 200 preferably includes conventional casing and risers rather than a specialty built and dimensioned riser.

If the riser 230 is a conventional, high-pressure riser, a surface BOP may be utilized at the platform 100 rather than a subsea BOP stack. If the riser 230 is a low-pressure riser comprising small diameter pipe, a subsea BOP stack will be utilized. Thus, the preferred pipe components, such as conductor casing 210 and riser 230, are significantly smaller and weigh significantly less than their conventional counterparts. Accordingly, the size requirements of the floating platform 100 can be significantly reduced because the size of the drilling rig can be reduced and less storage space is required. In preferred embodiments, it is unnecessary for the floating platform 100 to be equipped with a conventional sized drilling rig because the weight of the guide assembly 200 can be supported by lower capacity hoisting system, such as a crane 190. Preferably, the required hoisting system on the floating platform 100 comprises a crane 190, or a smaller than conventional derrick (not shown), or a specially designed tower system (not shown).

Figure 4:
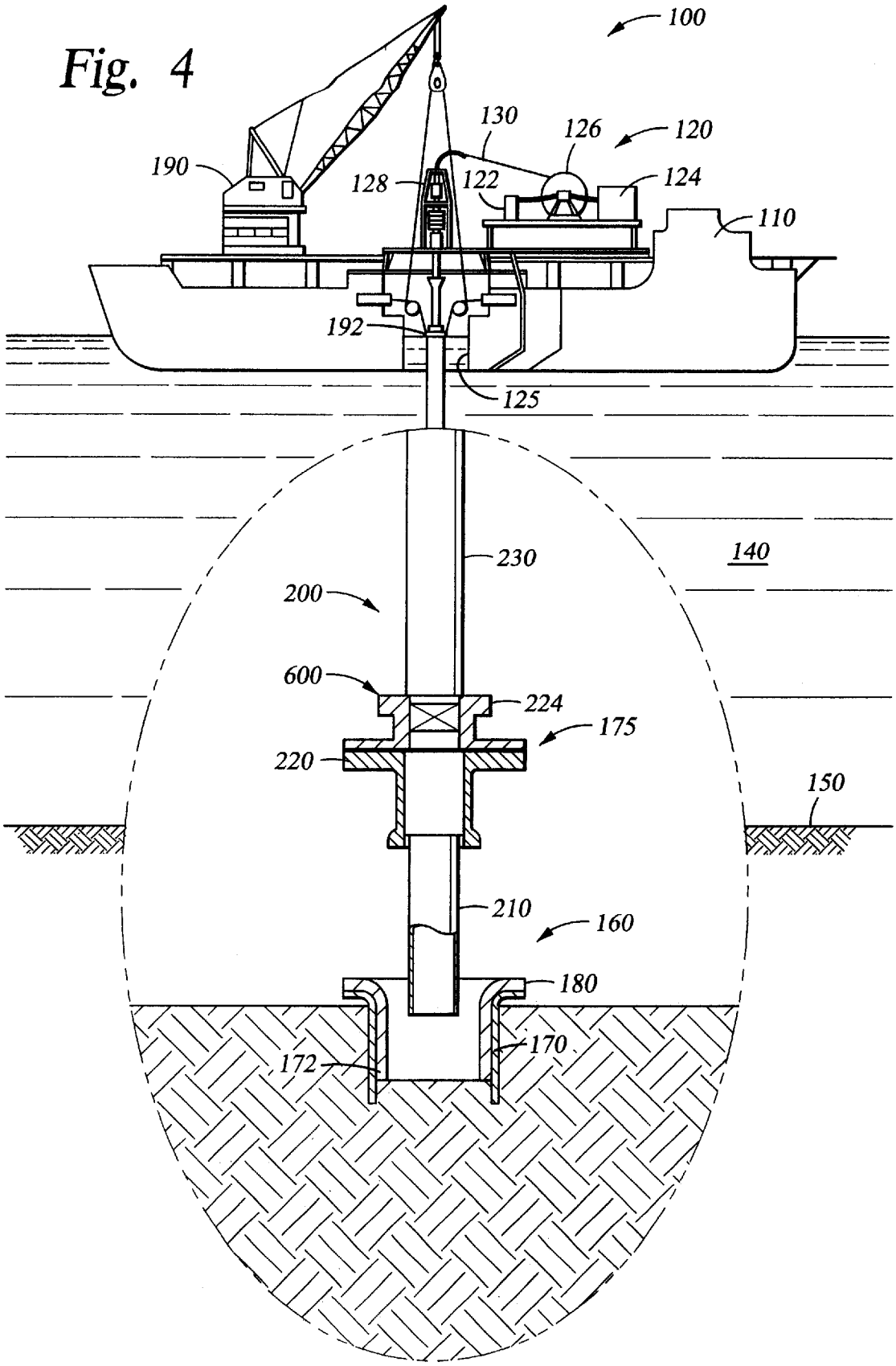
FIG. 4 is a schematic elevational view of the wellsite of FIG. 2 depicting the guide assembly being stabbed into the wellhead housing.

Referring now to FIG. 4, the guide assembly 200 is lowered to stab the lower end of the conductor casing 210 into the structural casing 170 and low-pressure wellhead housing 180. Casing 210 is stabbed to a depth adequate to restrain the guide assembly 200 during drilling.

Figure 5:
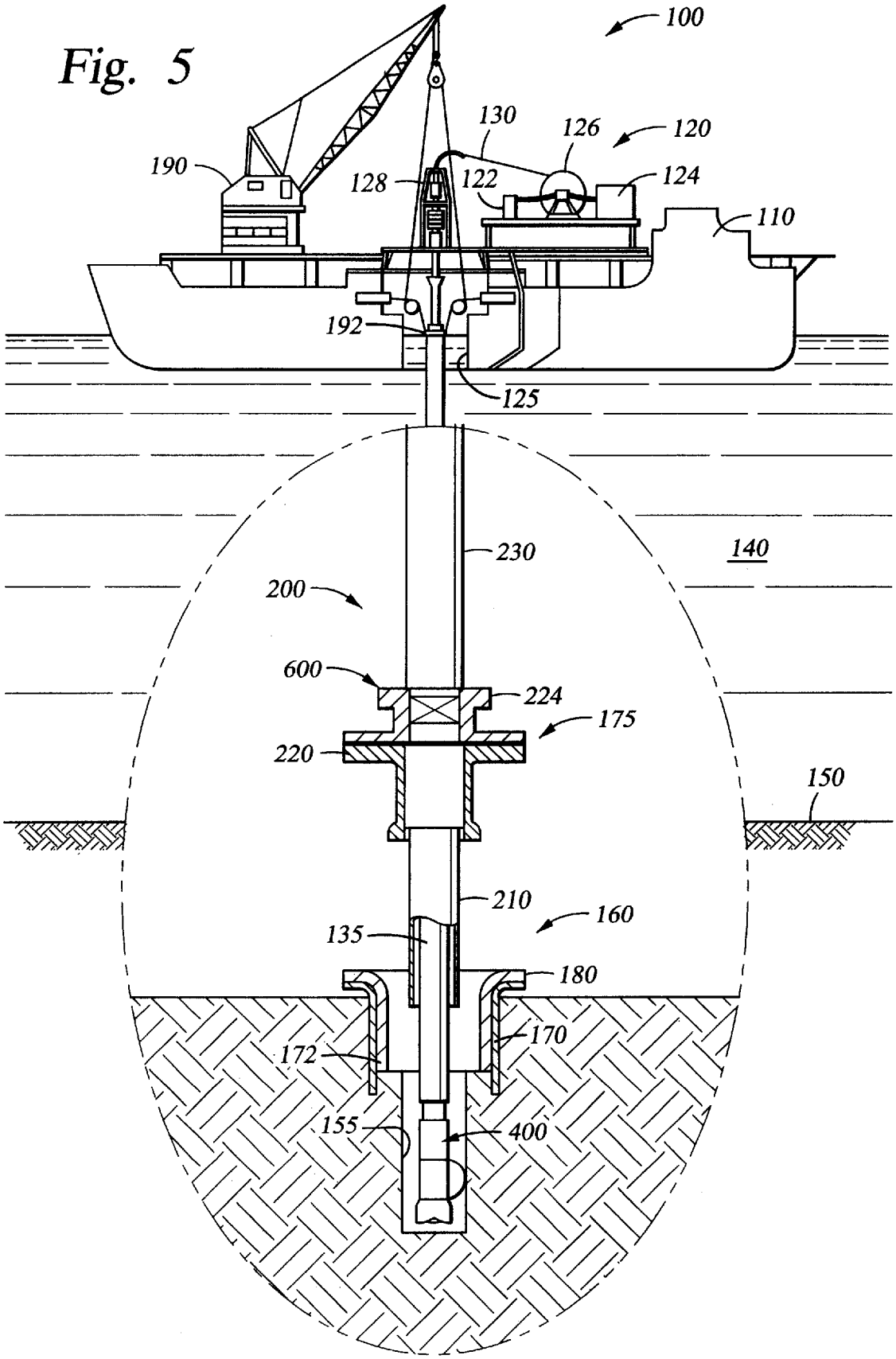
FIG. 5 is a schematic elevational view of the wellsite of FIG. 2 depicting a lightweight drill string extending through the guide assembly and supporting a BHA drilling a conductor casing borehole.

Referring now to FIG. 5, the drilling system 175 further includes a lightweight drill string 135 and a BHA 400 disposed at the end of the drill string 135 for drilling a borehole 155 below the structural casing 170 for the conductor casing 210. For example, the drill string 135 may have an outer diameter of 3⅛ inches. According to conventional drilling methods, riserless drilling is performed to drill a borehole for conductor casing below the structural casing 170 using a heavy drill string with a BHA disposed on its lower end. Riserless drilling is successful when using conventional drill pipe because it is large and heavy enough to withstand the lateral forces imposed by water currents. In contrast, the preferred drilling system 200 of the present invention utilizes a drill string 135 formed of a lightweight material, such as coiled tubing 130, for example, which has significantly less resistance to water currents. The lightweight drill string may be formed of composite coiled tubing 130, or metal coiled tubing, or any lightweight material, such as lightweight jointed pipe. Composite coiled tubing 130 is preferred over metal tubing or drill pipe not only due to weight considerations, but also because metal tubing or pipe is subject to fatigue, whereas composite coiled tubing 130 is not. The lighter the weight of the drill string 135, however, the greater the effect of the water current on the drill string 135. At some point, the drill string 135 becomes too light, such that the current adversely impacts the drill string 135 and prevents successful riserless drilling. Accordingly, the preferred embodiments of the present invention comprise methods for installing conductor casing that enable drilling through a riser.

In one preferred embodiment, the coiled tubing 135 is formed of a composite material, such as the coiled tubing disclosed in U.S. Pat. No. 6,296,066 to Terry et al., hereby incorporated herein by reference for all purposes, which is lighter than conventional metal drill pipe, and has an outer diameter (OD), such as for example 3⅛ inches, which is smaller than conventional drill pipe. Thus, by using the lighter weight coiled tubing 130, which is stored on a spool 126, a smaller than conventional floating drilling platform 100 may be used.

The coiled tubing drill string 135 extends through the guide assembly 200. The coiled tubing 130 has an outer diameter, which will pass through guide assembly 200. Thus, the guide assembly 200 and structural casing 170 provide lateral support for the drill string 135 to protect it from current effects imposed by the water 140 as the BHA 400 drills the borehole 155 for the conductor casing 210. Accordingly, as distinguished from conventional methods, which create the conductor casing borehole 155 via riserless drilling, in the preferred embodiments of the present invention, the guide assembly 200 is utilized to protect the preferably lightweight drill string 135 from bowing, bending, kinking or collapsing during the drilling of the conductor casing borehole 155.

Figure 6:
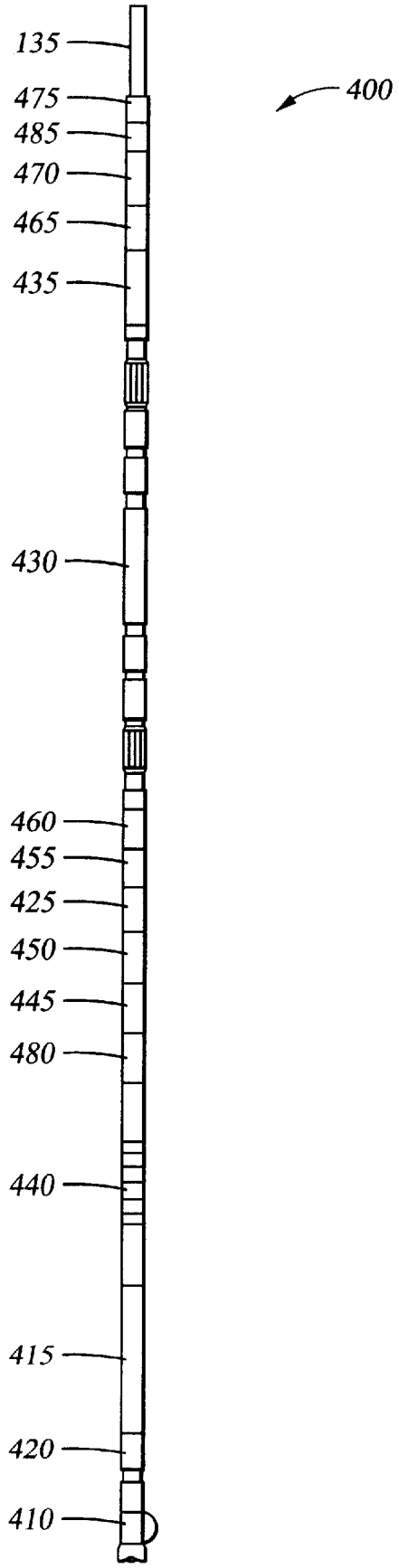
FIG. 6 is an enlarged view of the BHA of FIG. 5.

Referring now to FIG. 6, there is shown, by way of example, an enlarged view of a preferred BHA 400. Preferably the BHA 400 is suspended on the end of the composite coiled tubing drill string 135 and a bit 410 is disposed at the lowermost end of the BHA 400. To drill borehole 155 large enough for casing 210, the bit 410 must be capable of passing through casing 210 in guide assembly 200 and then drill a borehole 155 that is larger than the diameter of the conductor casing 210. Also, adequate annular space must be provided for cementing the conductor casing 210 into the borehole 155. Bit 410 may be a bi-center bit or alternately, a conventional drill bit and underreamer combination, or a conventional drill bit and winged reamer combination. These drilling combinations will perform the same slimhole drilling function.

The BHA 400 preferably further comprises a downhole motor 415 for rotating the bit 410, and tools for steering the BHA 400, such as a three dimensional steering tool 420, upper and lower circulation subs 425, 435, and a tractor 430 with borehole retention devices 432, 434. One exemplary tractor 430 is described in U.S. Pat. No. 6,003,606, hereby incorporated herein by reference for all purposes. The tractor 430 acts to anchor the BHA 400 in the borehole 155 and to allow tension to be maintained on the drill string 135 during drilling.

As one of ordinary skill in the art will readily appreciate, gravity-based drilling would work equally well for drilling the borehole 155 through the guide assembly 200. In gravity-based drilling, no tractor 430 is provided, and weight-on-bit is not provided by propulsion, but rather is based on injector 128 and the weight of the drill string 135 and BHA 400. Further, it should be appreciated that weight, such as drill collars, may be added above the BHA 400 to anchor the BHA 400 in the borehole 155.

The BHA 400 may also include various detectors and sensors, such as, for example, a resistivity sensor 440, a gamma ray sensor 445, a directional sensor 450, upper and lower tension/compression subs 455, 465, a pressure/temperature sub 460, a casing collar locator 470, and/or a voltage-converter sub 475. The BHA 400 may further include various disconnects, such as an electrical disconnect 480 and a ball drop disconnect 485. Accordingly, FIG. 6 depicts one representative grouping of components that may comprise the BHA 400. However, one of ordinary skill in the art will readily appreciate that the BHA 400 may be configured to include various components, and may include additional or fewer components than those depicted in FIG. 6, depending on the well plan.

Figure 7:
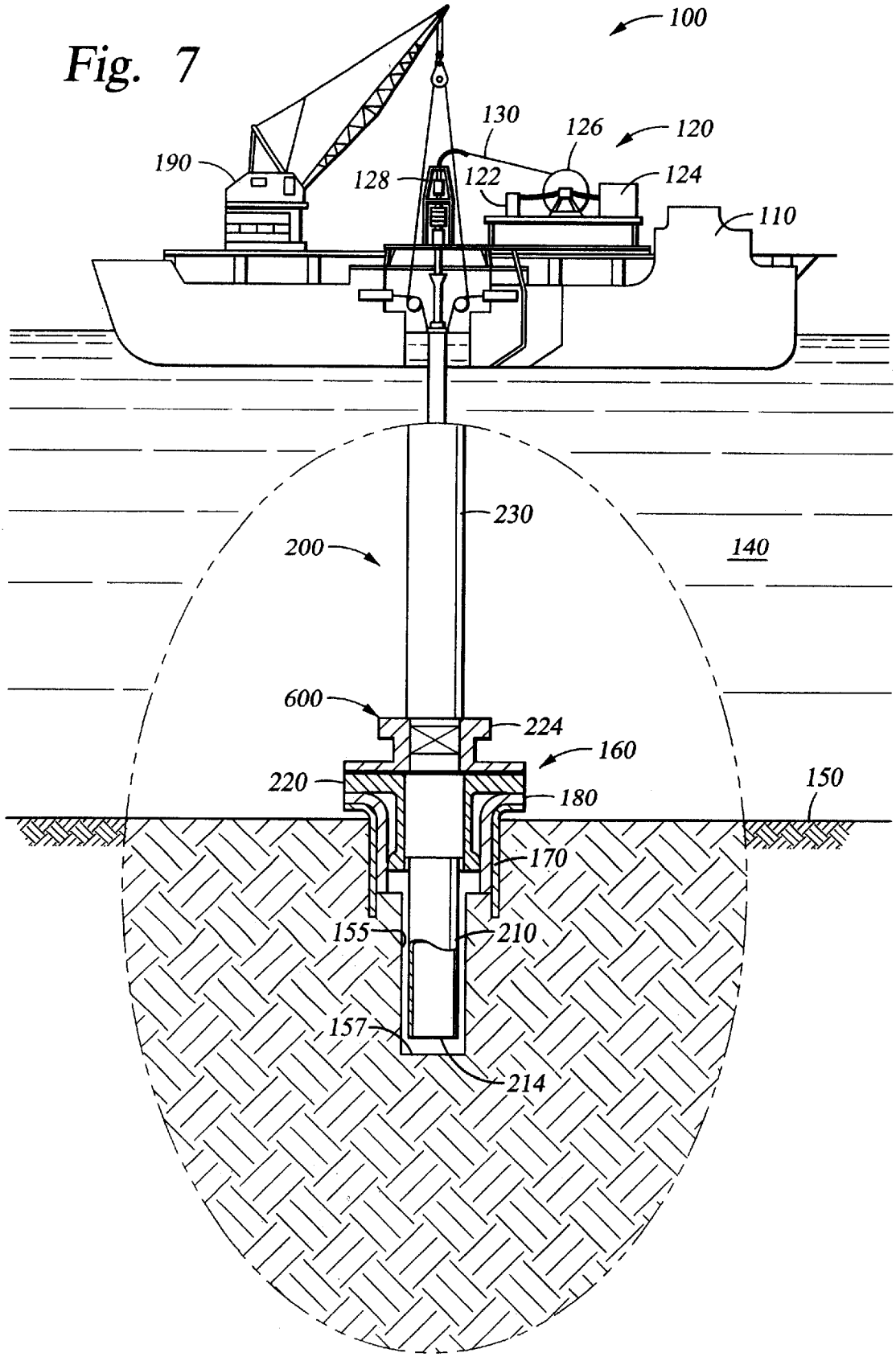
FIG. 7 is a schematic elevational view of the wellsite of FIG. 2 depicting the guide assembly in the run-in position such that a wellhead housing on the guide assembly is engaged with the low-pressure wellhead housing.

Referring now to FIG. 7, after the borehole 155 is drilled for the conductor casing 210, additional joints of riser 230 are connected at the floating vessel 110 to lower the guide assembly 200 and run the conductor casing 210 into the borehole 155 to the position shown in FIG. 7. The borehole 155 is preferably drilled to a depth such that when the lower end 214 of the conductor casing 210 is near the bottom 157 of the borehole 155, the high-pressure wellhead housing 220 engages and latches into the low-pressure wellhead housing 180, thereby forming wellhead 600.

Figure 8:
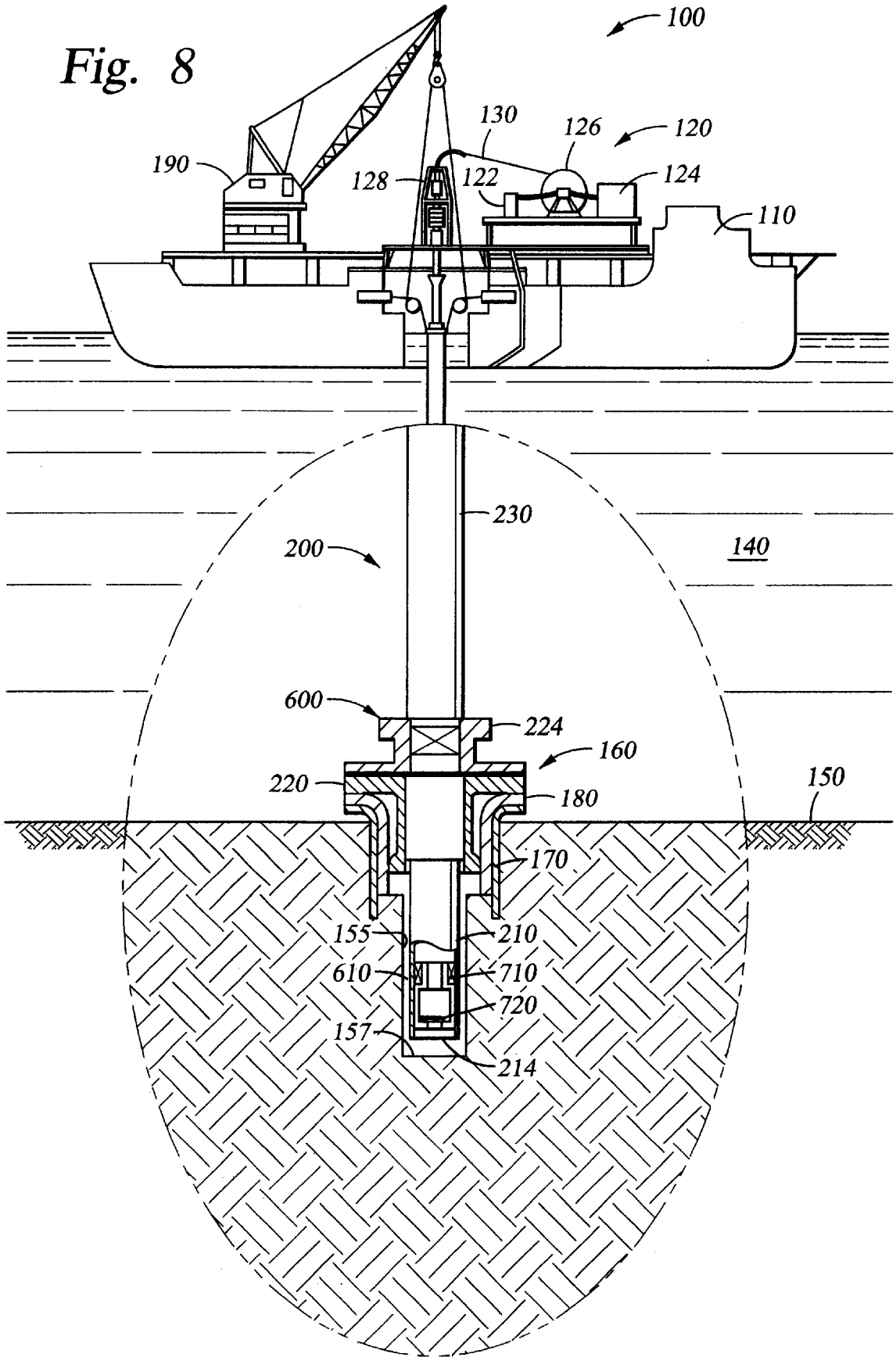
FIG. 8 is a schematic elevational view of the wellsite of FIG. 2 depicting a drillable packer and float valve installed at the lower end of the guide assembly.

Referring now to FIG. 8, once the conductor casing 210 is run into the borehole 155, a drillable packer 710 and float valve 720 combination is disposed at the lower end 214 of the conductor casing 210. In conventional drilling methods, the float valve 720, which is preferably a conventional check valve, is preinstalled into the lower end 214 of the conductor casing 210. The float valve 720 allows cement slurry to flow downwardly through the casing 210 and into the annulus 610 between the conductor casing 210 and the borehole 155, while preventing the cement slurry from flowing upwardly into the conductor casing 210. In conventional methods, once the conductor casing 210 is cemented, drilling for the surface casing would progress through the conductor casing 210, and the float valve 720 would simply be drilled away.

In contrast, as previously described, the preferred embodiments of the present invention include lowering the drill string 135 and BHA 400 through the conductor casing 210 to drill a borehole 155, then running the conductor casing 210 into the borehole 155 and cemented it into place. Therefore, the float valve 720 can not be preinstalled in the conductor casing 210 because it would present an obstruction to the BHA 400 when drilling the borehole 155. Accordingly, the preferred embodiments of the present invention include installing the conductor casing 210 into the drilled borehole 155, then connecting the float valve 720 to a drillable packer 710, and running them through the guide assembly 200 to the lower end 214 of the conductor casing 210 to the position shown in FIG. 8 before cementing commences. The packer 710 and float valve 720 may be installed in a variety of conventional ways, such as, for example, on the drill string 135, or on an electric wireline. Once the packer 710 and float valve 720 are set into the position shown in FIG. 8, the conductor casing 210 is cemented into place, and the remaining drilling operation would progress in a conventional manner.

Figure 9:
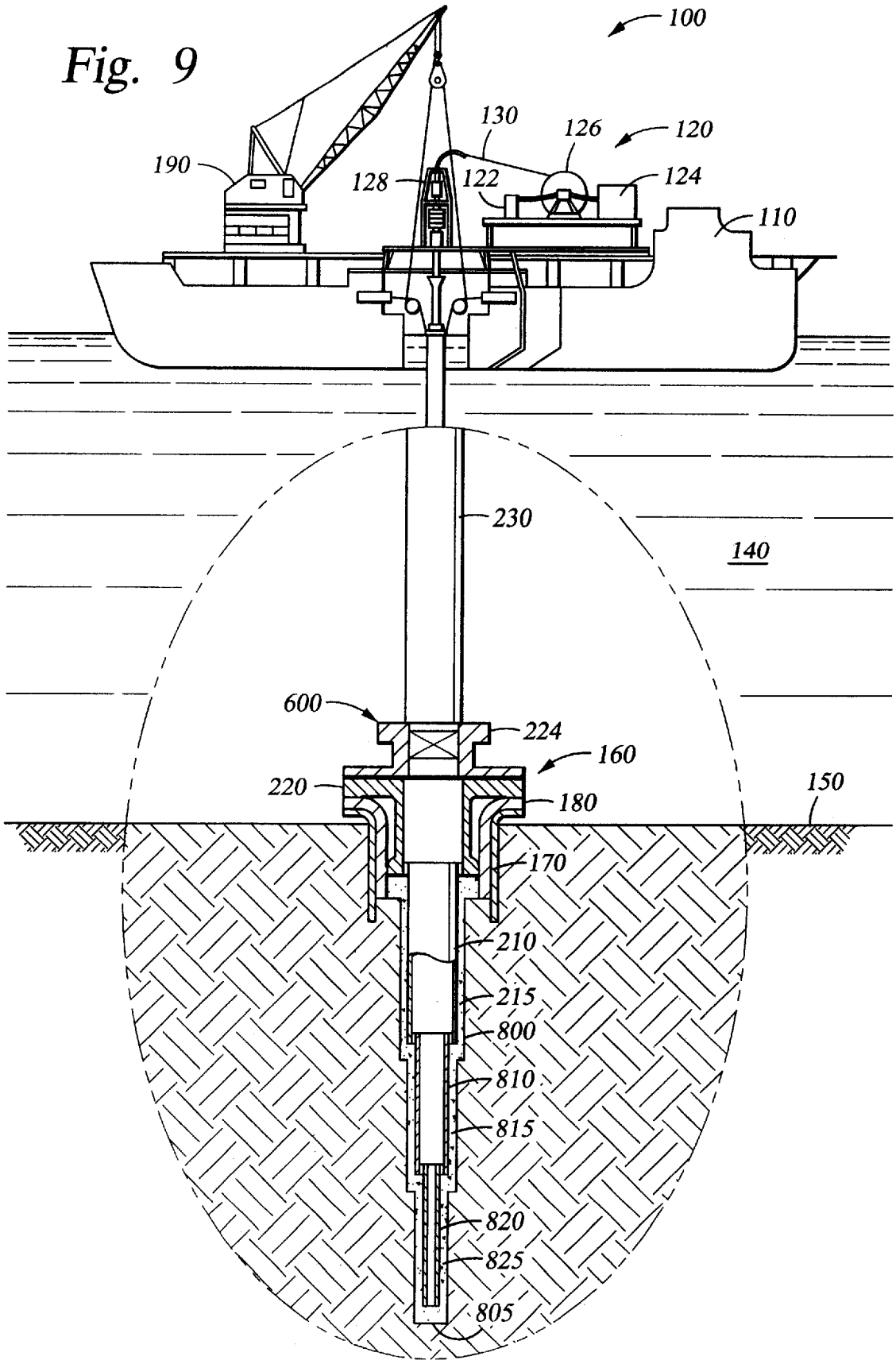
FIG. 9 is a schematic elevational view of the wellsite of FIG. 2 depicting a completed well with the riser still connected thereto.

Referring now to FIG. 9, there is shown one embodiment of a completed well 800, with the riser 230 still connected to the wellhead 600. In the completed well 800 of FIG. 9, the conductor casing 210, a surface casing 810, and a liner 820 are cemented into place at 215, 815, and 825 respectively. The surface casing 810 is preferably much smaller in diameter than conventional surface casing. For example, if the conductor casing 210 has an ID in the range of 4¾ inches to 5 inches, the surface casing 810 may have an OD of 3½ to 4½ inches, for example. The surface casing 810 is installed below the conductor casing 810 and preferably extends almost to the bottom 805 of the well 800. Typically a liner of a smaller diameter may be installed below the surface casing 810, such as a liner 820, which may have a OD of 2⅞ to 3½ inches, for example.

The conductor casing 210 must be large enough to enable passage of the surface casing 810 and subsequent liner 820 therethrough. Similarly, the surface casing 810 must be large enough to enable passage of the subsequent liner 820 therethrough. Thus, the portion of the well 800 that is lined with conductor casing 210 typically has a larger diameter than the portion of the well 800 where the subsequent liner 820 is positioned. Due to the preferably smaller diameter sizes of the conductor casing 210, surface casing 810, and subsequent liner 820 as compared to conventional components, the preferred embodiments of the present invention are best suited for wells that are shallow below the seafloor 150, such as wells extending to approximately 7,000 feet below the seafloor 150.

Alternatively, and more preferably, it is advantageous to use a casing system that does not utilize casings 210, 810 or liner 820 that have sequentially reduced diameters resulting in reductions in the diameter of the well 800 with depth. In particular, in preferred embodiments of the present invention, the casings 210, 810 and liner 820 are formed of expandable metal casing, such as the casing disclosed in U.S. Pat. 6,085,838 to Vercaemer et al., hereby incorporated herein by reference.

Expandable metal casing is made of a deformable material and is sized to have an outer diameter nearly equal to the inner diameter of previously installed casing strings, yet is small enough to allow the expandable casing to pass through the previously installed casing string. Thus, the expandable casing can be run through an upper casing string to position the expandable casing in a newly drilled borehole. A mechanical die member is disposed within the expandable casing string and is moved upwardly through the expandable casing in response to fluid pressure. The die member gradually deforms and expands the casing so as to have an internal diameter that is substantially equal to the internal diameter of the upper casing. Subsequent expandable casing strings can be installed as the well is drilled deeper. Therefore, utilizing expandable casing, essentially no limits would apply to the depth of the well 800 below the seafloor 150. Thus, use of expandable metal casing is preferred to avoid reductions in the diameter of the well 800 that would occur using conventional metal pipe components, such as the casings 210, 810 and liner 820 depicted in FIG. 9.

Accordingly, the preferred embodiments of the present invention provide improved methods and apparatus for conducting drilling operations from a bottom-founded or floating platform in any water depth, and especially for conducting drilling operations in deep or ultra-deep water from a floating platform. In particular, smaller diameter casings 210, 810, liner 820 and riser 230, as well as a lightweight, continuous drill string 135, are preferably utilized such that the required size and capacity of the platform 100 is significantly reduced. These efficiencies are expected to reduce the daily rate for the required floating platform 100 by approximately 50 percent as compared to a conventional vessel for ultra-deep water drilling operations. Further, the preferred embodiments of the present invention enable drilling of a borehole and installing casing into the borehole with minimal time delay between drilling the borehole and installing the casing, thereby reducing the possibility that an open borehole will collapse before casing can be run in.

While preferred embodiments of this invention have been shown and described, modifications thereof can be made by one skilled in the art without departing from the spirit or teaching of this invention. For example, the present invention is not limited to drilling in deep water from a floating platform, and it is equally applicable to drilling from a bottom-founded platform in shallow water. Further, the dimensions provided are exemplary only and not limiting, such that the one-trip method described herein for drilling a borehole and installing conductor casing is not limited to drilling slim boreholes, and it is equally applicable to drilling operations utilizing conventional sizes of conductor casing and riser. As another example, jointed drill pipe may be utilized instead of coiled tubing to make up the drill string. Thus, the embodiments described herein are exemplary only and are not limiting. Many variations and modifications of the methods and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A system for open hole drilling a borehole from an offshore platform and through a cased borehole at the seafloor, the system comprising:

a guide assembly extending from the platform to the seafloor and having a lower end extending into the cased borehole; and a bottomhole assembly disposed on a lightweight drill string extending through said guide assembly for drilling the borehole.

2. The system of claim 1 wherein said guide assembly is a pipe string.

3. The system of claim 1 wherein said guide assembly includes a casing.

4. The system of claim 1 wherein said guide assembly includes a riser.

5. The system of claim 1 wherein said guide assembly includes a casing and a riser attached to the casing by a head.

6. The system of claim 1 wherein said lightweight drill string includes metal coiled tubing.

7. The system of claim 1 wherein said lightweight drill string includes composite coiled tubing.

8. The system of claim 1 wherein said lightweight drill string includes lightweight jointed pipe.

9. The system of claim 1 wherein said bottomhole assembly includes a formation displacement member adapted to drill a borehole having a diameter greater than the diameter of the guide assembly.

10. The system of claim 9 wherein the formation displacement member includes a bi-center bit.

11. The system of claim 9 wherein said formation displacement member includes a conventional bit with an underreamer.

12. The system of claim 9 wherein said formation displacement member includes a conventional bit with a winged reamer.

13. The system of claim 1 further including a drilling fluid flowing through said drill string and said bottomhole assembly and flowing through a fluid passageway around the bottomhole assembly and between said lower end and the cased borehole into the sea.

14. The system of claim 1 further comprising a hoisting system capable of supporting the guide assembly.

15. The system of claim 1 wherein said bottomhole assembly enables drilling of a slim borehole.

16. The system of claim 4 wherein said riser comprises a conventional high-pressure riser.

17. The system of claim 4 wherein said riser comprises a small diameter low pressure riser.

18. A method for open hole drilling a new borehole from an offshore platform and through a cased borehole at the seafloor, the method comprising:

lowering a guide assembly from the platform to the seafloor;

inserting the lower end of the guide assembly into the cased borehole and forming an annulus therearound;

lowering a bottomhole assembly on a lightweight drill string through the guide assembly;

flowing a drilling fluid through the drill string and bottomhole assembly to drill the new borehole;

flowing the drilling fluid and cuttings up through another annulus formed by the drill string and new borehole and through the annulus formed by the lower end of the guide assembly and cased borehole into the sea water;

removing the drill string and bottomhole assembly from the cased borehole and guide assembly; and lowering the guide assembly into the new borehole.

19. The method of claim 18 further including utilizing the guide assembly as a riser between the platform and seafloor in the drilling of subsequent boreholes.

20. The method of claim 18 further comprising: disposing a float valve at the lower end of the guide assembly;

cementing the guide assembly into the new borehole;

extending the bottomhole assembly suspended on the drill string through the guide assembly; and drilling a subsea borehole below the guide assembly.

21. The method of claim 18 wherein the guide assembly comprises a conductor casing and a riser pipe.

22. The method of claim 18 wherein the drill string is composite coiled tubing.

23. The method of claim 18 wherein lowering the guide assembly into the new borehole comprises lowering a casing into the new borehole.

24. The method of claim 18 wherein lowering the guide assembly into the new borehole further comprises the formation of a subsea wellhead.

25. The method of claim 18 wherein the new borehole comprises a slim borehole.

26. The method of claim 18 wherein the new borehole is drilled and the guide assembly is lowered into the new borehole in one trip from the platform.

27. The method of claim 18 wherein lowering the guide assembly from the platform comprises lowering the guide assembly by a hoisting system on the platform.

28. The method of claim 20 wherein cementing the guide assembly into the new borehole comprises cementing a casing into the new borehole.

29. The method of claim 20 further comprising lowering a liner into the subsea borehole.

30. The method of claim 29 wherein the liner comprises expandable metal casing.

* * * * *